US005844467A

United States Patent [19]

Shea

[11] Patent Number: 5,844,467

[45] Date of Patent: Dec. 1, 1998

[54] LOW INDUCTANCE SHUNT FOR CURRENT LIMITING POLYMER APPLICATIONS

[75] Inventor: John Joseph Shea, Pittsburgh, Pa.

[73] Assignee: Eaton Corporation, Cleveland, Ohio

[21] Appl. No.: 788,605

[22] Filed: Jan. 24, 1997

[51] Int. Cl.[6] ..... H01C 3/02

[52] U.S. Cl. ..... 338/61; 219/505; 219/243

[58] Field of Search ..... 338/22 R, 61; 219/505, 243

[56] References Cited

U.S. PATENT DOCUMENTS

| | | | |
|---|---|---|---|
| 3,925,707 | 12/1975 | Bhate et al. | 317/11 |
| 4,024,427 | 5/1977 | Belhomme et al. | 315/8 |
| 4,501,951 | 2/1985 | Benin et al. | 219/243 |
| 4,568,907 | 2/1986 | Hurtle et al. | 338/61 |
| 5,064,997 | 11/1991 | Fang et al. | 219/505 |
| 5,471,035 | 11/1995 | Holmes et al. | 219/505 |
| 5,530,613 | 6/1996 | Bauer et al. | 361/58 |
| 5,667,711 | 9/1997 | Mody et al. | 219/505 |

OTHER PUBLICATIONS

Raychem "Polyswitch"® Devices Standard Product List.

Asea Brown Boveri, ABB Control Poduct Bochure *New Current Limiter*.

Asea Brown Boveri, ABB Control Product Brochure *Motor Starter Protection With PROLIM—The Complete Solution*.

Asea Brown Boveri, ABB Control Product Brochure *There Are Lots Of Novelties And Sensations, But Only A Few Innovations*.

*Primary Examiner*—Teresa J. Walberg
*Assistant Examiner*—Jeffrey G. Pwu
*Attorney, Agent, or Firm*—Martin J. Moran

[57] ABSTRACT

Electrical devices based on current limiting PTC polymer devices, and in particular, electrical circuit protection devices containing a current limiting PTC polymer device composed of a current limiting polymer composition in combination with suitable electrodes and a low inductance shunt to protect the current limiting polymer composition from exceeding its breakdown field strength. Specifically, electrical devices containing a current limiting polymer composition in combination with suitable electrodes and a low inductance shunt in the form of a ribbon shunt, i.e. a flat sheet of conductive material folded over on itself.

15 Claims, 2 Drawing Sheets

LOW INDUCTANCE SHUNT FOR CURRENT LIMITING POLYMER APPLICATIONS

BACKGROUND OF THE INVENTION

1. Field of the Invention

This invention relates to electrical devices based on current limiting PTC polymer devices, and in particular to electrical circuit protection devices comprising a current limiting PTC polymer device composed of a current limiting polymer composition in combination with suitable electrodes. The invention also concerns the use of a low inductance shunt to protect the current limiting polymer composition from exceeding its breakdown field strength. Specifically, the invention concerns a shunt consisting of a flat sheet of conductive material, i.e. stainless steel, folded over on itself.

2. Background of the Invention

Current limiting polymer compositions which exhibit positive temperature coefficient of resistance (PTC) behavior, and electrical devices comprising current limiting polymer compositions have been widely used. The current limiting polymer compositions generally include conductive particles, such as carbon black, graphite or metal particles, dispersed in a polymer matrix, such as thermoplastic polymer, elastomeric polymer or thermosetting polymer. PTC behavior in a current limiting polymer composition is characterized by the material undergoing a sharp increase in resistivity as its temperature rises above a particular value otherwise known as the anomaly or switching temperature, $T_S$. Materials exhibiting PTC behavior are useful in a number of applications including use in molded case circuit breaker applications.

Devices using current limiting polymer compositions have long been used for electrical circuit protection. Such devices usually contain a current limiting polymer composition with two electrodes attached thereto. When connected to a circuit, these circuit protection devices have a relatively low resistance under normal operating conditions of the circuit, but are tripped, that is, converted into a high resistance state when a fault condition, for example, excessive current or temperature, occurs. Namely, when excessive current passes through the device or when the device is subjected to excessively high temperature, the current limiting polymer composition will undergo a transition transforming it to its high resistance state. Those in the art will understand that the terms excessive current and excessively high temperature are relative terms which derive their meaning based on the transition temperature or switching temperature, $T_s$, for the particular current limiting polymer composition involved.

Representative electrical circuit protection devices and current limiting polymer compositions for use in such devices are described, for example, in U.S. Pat. Nos. 4,545,926 (Fouts, Jr., et al.); 4,647,894 (Ratell); 4,685,025 (Carlomagro); 4,724,417 (Au, et al.); 4,774,024 (Dep, et al.); 4,775,778 (van Konynenburg, et al.); 4,857,880 (Au, et al); 4,857,880 (Au, et al.); 4,910,389 (Sherman, et al.); 5,049,850 (Evans); and 5,195,013 (Jacobs, et al.).

Such devices, however, have for the most part been limited, to use in low power systems. One of the phenomena that has operated to generally limit the use of these devices to low power applications is referred to in the art as internal breakdown due to the critical electric field of the current limiting polymer composition being exceeded. Low power applications would comprise, for example, small 12 $V_{dc}$ motors and telecommunication applications where the system voltage is <600 V and the steady state current is <10 A. However, these are maximum ratings for system voltage and steady state current individually, namely the maximum system voltage and steady state current are not obtainable simultaneously. For example, a typical device rating might be 250 V maximum with a 0.15 A steady state current. The internal breakdown is characterized by arcing either at the surface of or within the polymer composition. This arcing results in cracking/voids in the polymer composition which degrades the device performance.

What is needed are devices based on current limiting polymer compositions which may be used in high power applications such as high fault current limiting protection of circuit breakers and motor starters for AC power distribution components for industrial and residential applications, i.e., system voltages up to 600 $V_{rms}$ and steady state currents up to 100 $A_{rms}$ with prospective fault currents up to 100 $kA_{rms}$. For example, what is needed are devices based on current limiting polymer compositions which may be utilized in molded case circuit breaker applications.

One such device currently available commercially utilizes a current limiting polymer composition in series with a fast current limiting miniature circuit breaker. Said polymer device has a voltage rating of 500 $V_{rms}$ and a current rating of 63 $A_{rms}$. The current limiting polymer composition used therein provides for reduced let-through values for the device compared to conventional molded case circuit breakers.

To help combat the problems of internal breakdown of the current limiting polymer composition used in these currently available molded case circuit breakers, a wire shunt is used. The wire shunt is connected in parallel with the current limiting polymer composition across the two electrodes attached thereto or imbedded therein. Fault currents are commutated from the current limiting polymer composition to the shunt when the temperature of the current limiting polymer composition corresponds with the switching temperature for that composition. Measurements show that the wire shunt used in commercially available devices has an inductance of 1.2 $\mu$H. The greater the series inductance of the shunt, the higher the switching voltage will be across the current limiting polymer composition during transition from its low resistance state to its high resistance state. The switching voltage occurs due to the sharp increase in resistance at the point of transition while current is flowing through the current limiting polymer composition. Accordingly, a lower inductance shunt would result in a lower switching voltage further protecting the current limiting polymer composition from exceeding its breakdown field strength. In so doing, such a low inductance shunt will allow for the incorporation of current limiting polymer compositions in high power applications.

What is needed is a low inductance shunt for use with current limiting polymer compositions incorporated into electrical and system protection devices designed for high power systems having steady state currents up to 250 $A_{rms}$, prospective fault currents of 100 $kA_{rms}$ with system voltages up to 690 $V_{rms}$.

SUMMARY OF THE INVENTION

We have now discovered a low inductance shunt for incorporation into electrical system protection devices designed for high power applications, i.e. molded case circuit breaker applications, along with current limiting polymer compositions. Specifically, it has been discovered that a ribbon shunt consisting of a flat sheet of appropriate conductive material, i.e., stainless steel, folded over on itself may provide both the desired resistivity and low inductance.

It is an object of the invention to provide a low inductance shunt for incorporation into current limiting polymer composition containing electrical devices designed for use in high power system applications.

The invention resides in a low inductance ribbon shunt comprising a flat sheet of appropriate conductive material, for example stainless steel, folded over onto itself in a geometry that provides low inductance along with the desired resistivity.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the spirit and scope of the appended claims. In the drawings.

DETAILED DESCRIPTION OF THE PREFERRED EMBODIMENTS OF THE INVENTION

Figure 1:
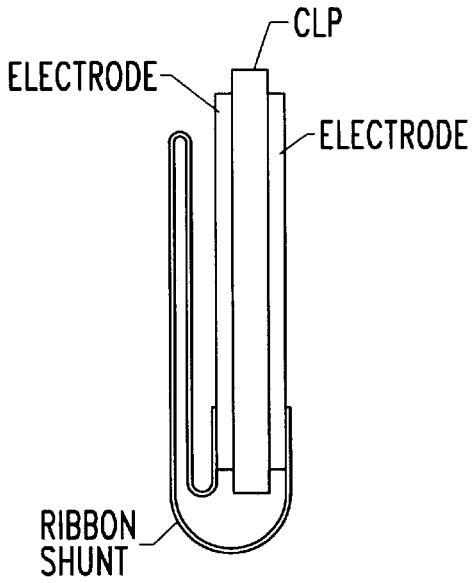
FIG. 1 is a depiction of one possible configuration for a ribbon shunt of the invention.

The novel ribbon shunts of the invention are characterized by having a low inductance such that the switching voltage across a current limiting polymer composition, incorporated in parallel with the ribbon shunt in an electrical device, can be minimized. Specifically, the ribbon shunts of the invention comprise a flat sheet of conductive material of desired resistivity folded over onto itself to provide the desired inductance of less than 200 $\mu$H.

The ribbon shunt material should be selected from the group of conductive materials having a resistance in the range of 0.05Ω to 100Ω, preferably 0.05Ω to 2Ω, most preferably 0.1Ω. Furthermore, the selected material must possess a resistivity of 10 $\mu$Ω.cm to 500 $\mu$Ω.cm, preferably 100 $\mu$Ω.cm. The ribbon shunt material should be selected from a group of conductive materials having, melting points above 1000° C. and generally high specific heats. Potential candidate materials which meet these requirements are listed in Table 1. Generally, materials which are malleable and low in cost with high melting temperatures and which have high resistivity are preferred. Those skilled in the art will know to choose the appropriate shunt material to obtain the desired shunt resistance in the range of 0.05Ω to 10Ω, preferably 0.1Ω to 2Ω and most preferred 0.1Ω in a reasonable shunt volume.

TABLE 1

| MATERIAL | RESISTIVITY ($\mu\Omega \cdot$ cm) | MELTING POINT (°C.) |
|---|---|---|
| Metallic Glasses | | |
| Co 66/Si 15/B 14/Fe 4/Ni 1 | 142 | N/A |
| Co 70/Si + B 23/Mn 5/Fe + Mo 2 | 130 | N/A |
| Fe 40/Ni 38/B 18/Mo 4 | 138 | N/A |
| Iron/Boron/Silicon | 124 | N/A |
| Ni 78/B 14/Si 8 | 90 | N/A |
| Invar | | |
| Fe 64/Ni 36 | 80 | N/A |
| Aluchrom O | 140 | 1520 |
| Fecralloy (Iron/Chromium) | 134 | 1380–1490 |
| Chromaloy O (Fe 75/Cr 20/Al 5) | | |
| Stainless Steel 302 | 71 | 1400–1420 |
| Stainless Steel 304 | 71 | 1400–1455 |
| Stainless Steel 310 | 70–78 | 1400–1455 |
| Stainless Steel 316 | 70–78 | 1370–1400 |
| Stainless Steel 321 | 70–73 | 1400–1425 |
| Stainless Steel 347 | 70–73 | 1400–1425 |
| Stainless Steel 410 | 56–72 | 1480–1530 |
| Stainless Steel 15-7PH | 80 | |
| Stainless Steel 17-7PH | 80–85 | 1435 |
| Incoloy 800 | 93–100 | 1350–1420 |
| Iconel 718 | 125 | 1260–1335 |
| Iconel 600 | 103 | 1370–1425 |
| Iconel X | 123 | 1390–1425 |
| Shaped Memory Alloy (Ni/Ti) | 100 Austinite | 1310 |
| Hastelloy C | 125–130 | 1270–1390 |
| Hastelloy B | 137 | 1340–1390 |
| Waspaloy | 120–130 | 1340–1390 |
| Evanohm | 134 | 1340–1390 |
| Nichrome V (Ni 80/Cr 20) | 108 | 1400 |
| Chromel | 71 | 1420 |
| Ti 90/Al 6/V 4 | 168 | 1600–1650 |
| Carbon Paper | 1375 | 3650 |
| Manganese | 160 | 1244 |
| Iron | 10 | 1535 |
| Elgiloy | 100 | 1427 |

The ribbon shunt must be properly sized to withstand the energy it could be exposed to during a fault current or excessive temperature condition while also providing the desired resistance. The maximum energy absorption capacity limit for a given ribbon shunt material may be taken as the melting point of said material as calculated using equation number (1):

$$Q = \int_{t_s}^{t_1} i^2 R\, dt = C_p \Delta T\, \delta\, v = C_p \Delta T\, \delta A\, l \tag{1}$$

wherein Q is the maximum energy absorption capacity, v is the volume of the shunt, i is the instantaneous current through the shunt, t is the time the current is flowing in the shunt, $t_s$ is the time where transition occurs, $t_1$, is the time at which the current through the shunt ceases, $\Delta T = T_{melting} - T_{ambient}$, $T_{melting}$ is the melting point temperature for the shunt material, $T_{ambient}$ is the ambient temperature, $C_p$ is the specific heat capacity of the shunt material, δ is the density of the shunt material, A is the cross sectional area of the shunt, and l is the length of the shunt material. The cross-sectional area, length and type of the material used for the ribbon shunt will affect the resistance thereof according to equation (2):

$$R = \rho \frac{l}{A} \tag{2}$$

wherein R is the resistance, ρ is the resistivity, 1 is the length of the shunt and A is the cross-sectional area of the shunt. One skilled in the art would know to use equation (1) and equation (2) to determine the appropriate combination of shunt cross-sectional area and length for a given shunt material to provide a ribbon shunt with an adequate withstand strength and resistance for a given application.

The ribbon shunts of the invention are coated with an electrically insulating material, i.e. kapton tape, and then they are folded over onto themselves in a geometry that provides an inductance of less than 400 $\mu$H, preferably less than 190 $\mu$H. Table 2 lists the inductance at 60 Hz of different geometries using a ribbon shunt made from a sheet of 304 stainless steel that was 2" wide, 0.002" thick and 18" long. Table 2 also lists the inductance for two different geometries using a wire shunt for comparison purposes.

TABLE 2

| Geometry | Description | Inductance (nH) |
|---|---|---|
| 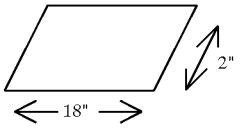  | Flat Sheet | 394 |
| 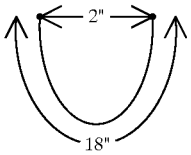  | U-Shaped | 319 |
| 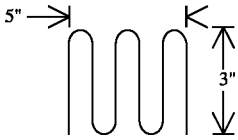  | Serpentine | 280 |
| 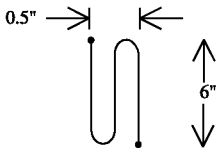  | S-Shaped | 190 |
| 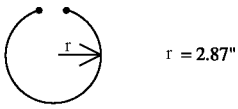  | Circular | 168 |
| 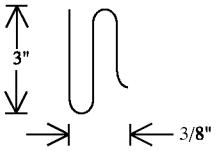  | S-Shaped Wire | 1200 |
| 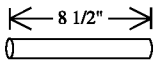  | Straight Wire | 1300 |

The actual geometry chosen will likely be determined by the packaging volume available. The minimum inductance should be chosen for a given geometry. This can be determined experimentally. In general, the wider the ribbon shunt the lower the inductance. Folding the ribbon onto itself may be needed to fit into the available space. The folds must be insulated to prevent shorting out the shunt. Appropriate insulation must be capable of withstanding the voltage and the temperature of the metal during a short circuit condition. Suitable insulation can include, but is not limited to, the following: woven glass fiber, KAPTON®, ceramic paper, fishpaper, teflon, glass filled melamine, polyesters and epoxies.

Figure 2:
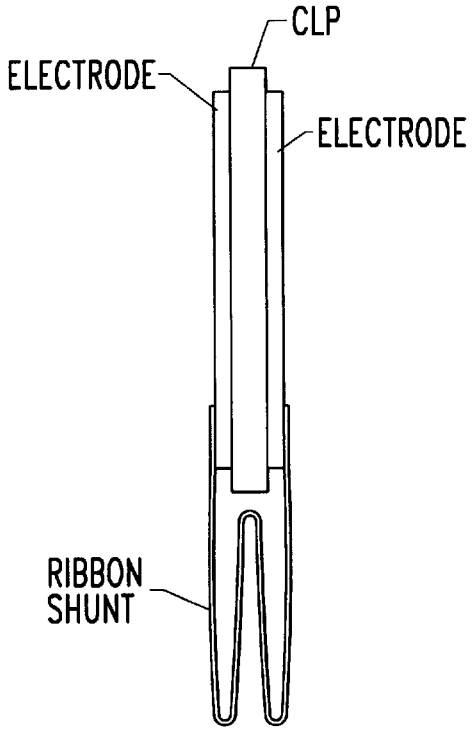
FIG. 2 is a depiction of another possible configuration for a ribbon shunt of the invention.
Figure 3:
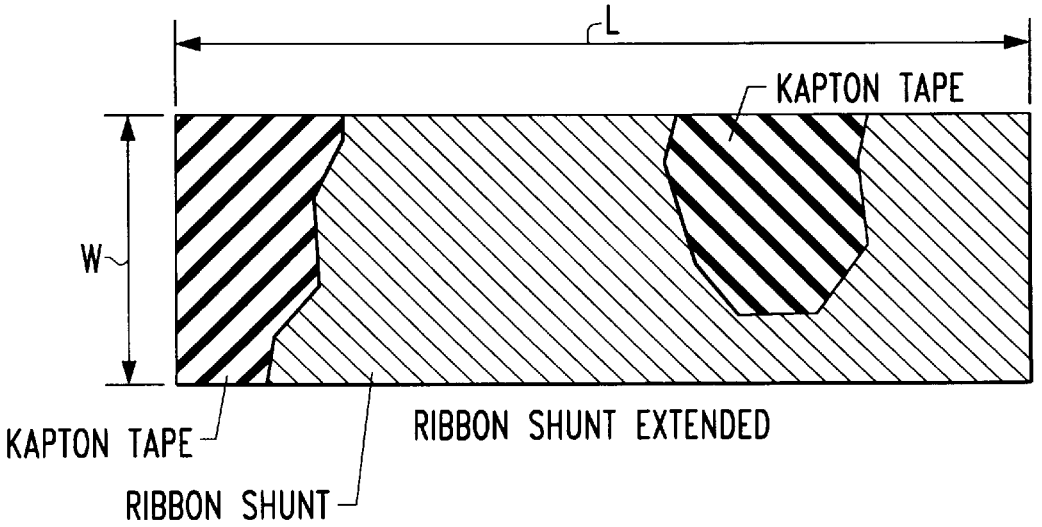
FIG. 3 is a top cross-sectional view of a ribbon shunt of the invention.

Two possible configurations for the ribbon shunts of the invention are shown in FIGS. 1 and 2. A top cross-sectional view of a ribbon shunt for use with the invention is shown in FIG. 3.

Figure 4:
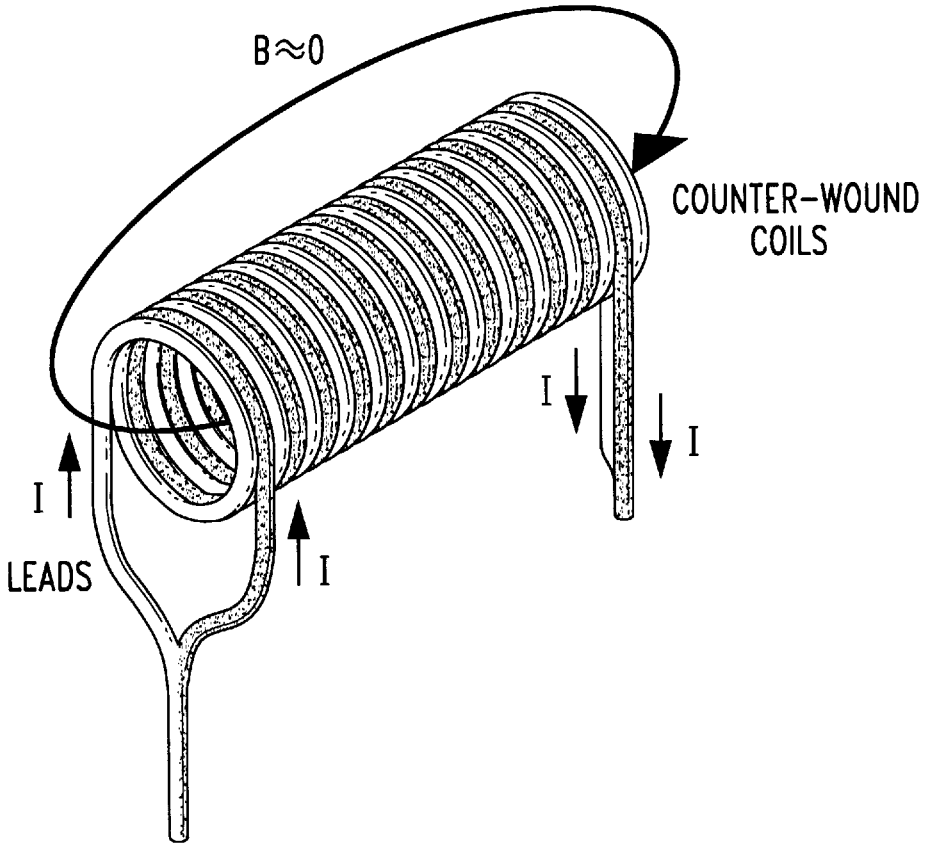
FIG. 4 is a depiction of a wire shunt comprising a pair of counter-wound coils; and, FIG. 5 is a depiction of a wire shunt comprising a pair of twisted counter wound wires.
Figure 5:
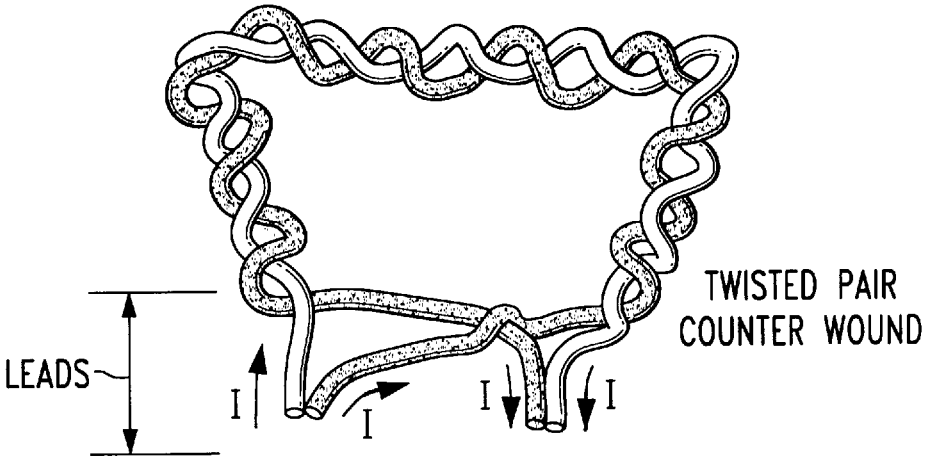

An alternative design consisting of counter wound wires is shown in FIGS. 4 & 5. This design allows the use of wires rather than a ribbon shunt. The design may be either a cylindrical coil design as shown in FIG. 4 or a twisted wire pair design as shown in FIG. 5. The inductance of one coil of wire cancels the inductance of the other coil. In order for this design to be effective the lead length, i.e. the length of uncoiled or untwisted wire, must be kept as short as possible, i.e., less than 1", preferably less than 0.5", and the wires should be kept as close as physically possible. Wires must be insulated from each other. Appropriate insulation must be capable of withstanding the voltage and the temperature of the wire during a short circuit condition. Suitable insulation includes, but is not limited to: woven glass fiber, KAPTON®, ceramic paper, fishpaper, glass filled melamine, teflon, polyesters, and epoxies. The desired shunt resistance remains the same as previously stated. Thus, the resistance of each coil or wire needs to be double the desired shunt resistance.

The invention will now be illustrated by the following Example, which is intended to be purely exemplary and not limiting in any way.

EXAMPLE 1

A current limiting polymer composition comprising polyethylene and activated carbon was connected in parallel with a ribbon shunt of the invention as shown in FIG. 3. The ribbon shunt used was constructed of 304 stainless steel, namely shim stock from Lyon Industries material number QQ-S-766 in 0.002 inch thickness. The resistivity of the shunt material was measured at 71 $\mu\Omega$.cm. The cross-sectional area used was $25.8\times10^{-3}$ cm$^2$, namely 2"×0.002". A 36.3 cm length was used to provide a desired resistance of 0.1Ω. Using equation (1), the maximum energy absorption capacity of this shunt would be 4.54 kJ where $C_p$=0.444 J/g°K (Iron), $\Delta T$=1375° K, $\delta$=7.93 g/cm$^3$ and v=0.937 cm$^3$. Note that it is assumed that the time during which current will be flowing through the shunt under fault conditions will be less than one half cycle. The shunt dimensions and material should be designed to insure that the maximum energy absorption capacity of the shunt is not exceeded for the intended system voltage.

The shunt/current limiting polymer composition combination was then subjected to fault current conditions with a system voltage of 150 $V_{dc}$. The peak switching voltage across the combination was measured at 277 $V_p$. Under similar conditions, the current limiting polymer composition unprotected by a shunt had a peak switching voltage of 684 $V_p$.

It is to be understood that the present invention is not intended to be limited to the exact details of construction, operation, materials or embodiment shown and described herein, as obvious modifications and equivalent will be apparent to one skilled in the art of treating skin anomalies. For example, the device and method of present invention could be applied to any wound. This disclosure is intended to cover all alternatives, modifications and equivalents as may be included within the spirit and scope of the invention as defined by the appended claims.

The following claims represent the scope of this invention to the extent that it is subject to such delimitations. It will be appreciated by those skilled in the art that the anticipated uses and embodiments of the present invention are not amenable to precise delineation, but may vary from the exact language of the claims. Thus, the following claims are drawn not only to the explicit limitations, but also to the implicit embodiments embraced by the spirit of the claims.

We claim:

1. An electrical device, comprising:

a current limiting polymer composition;

at least two electrodes attached to said current limiting polymer composition; and a ribbon shunt connected to said at least two electrodes in electrical parallel with said current limiting polymer composition;

wherein the ribbon shunt is folded over onto itself; wherein the ribbon shunt is constructed of stainless steel and wherein the ribbon shunt has a resistivity of 56 $\mu\Omega$.cm to 85 $\mu\Omega$.cm.

2. The electrical device of claim 1 wherein the ribbon shunt has a resistance in the range of 0.05Ω to 2Ω.

3. The electrical device of claim 1 wherein the ribbon shunt has a resistance range of about 0.2Ω.

4. The electrical device of claim 1 wherein the ribbon shunt is coated with an electrically insulating material.

5. The electrical device of claim 4, wherein the electrically insulating material is selected from the group consisting of woven glass fiber, ceramic paper, fishpaper, glass filled melamine, teflon, polyesters, and epoxies.

6. The electrical device of claim 1 wherein the ribbon shunt has a maximum energy absorption capacity of 4.5 kJ as calculated using equation (1):

$$Q=C_p\Delta T\delta v=C_p\Delta T\delta A\,l \quad (1)$$

wherein:

Q=the maximum energy absorption capacity, v=the volume of the shunt, $\Delta T=T_{melting}-T_{ambient}$, $T_{melting}$=the melting point temperature for the shunt material $T_{ambient}$=the ambient temperature $C_p$=the specific heat capacity of the shunt material, δ=the density of the shunt material, A=the cross sectional area of the shunt, and l=the length of the shunt material.

7. The electrical device of claim 1 wherein said device is a system protection device for use in high power systems wherein the system steady state current is up to 250 $A_{rms}$ with system voltage up to 690 $V_{rms}$ and prospective fault currents up to 100 $kA_{rms}$.

8. The electrical device of claim 1 wherein the switching voltage across the current limiting polymer composition during transition from its low resistance state to its high resistance state depends on the switching rate of resistance rise and the current.

9. The electrical device of claim 1 wherein the ribbon shunt has an inductance below 200 $\mu$H.

10. A molded case circuit breaker, comprising:

a current limiting polymer composition;

at least two electrodes attached to said current limiting polymer composition; and, a ribbon shunt connected to said at least two electrodes in electrical parallel with said current limiting polymer element;

wherein the ribbon shunt is folded over onto itself; wherein the ribbon shunt is constructed of stainless steel and wherein the ribbon shunt has a resistivity of 56 $\mu\Omega$.cm to 85 $\mu\Omega$.cm.

11. The molded case circuit breaker of claim 10 wherein the ribbon shunt has a resistance in the range of 0.05Ω to 2Ω.

12. The molded case circuit breaker of claim 10 wherein the ribbon shunt has a resistance in the range of 0.1Ω.

13. The molded case circuit breaker of claim 10 wherein the ribbon shunt is coated with an electrically insulating material.

14. The molded case circuit breaker of claim 13 wherein the electrically insulating material is selected from the group consisting of woven glass fiber, ceramic paper, fishpaper, glass filled melamine, teflon, polyesters, and epoxies.

15. The molded case circuit breaker of claim 10 wherein the ribbon shunt has a maximum energy absorption capacity of 4.5 kJ as calculated using equation (1):

$$Q=C_p\Delta T\delta v=C_p\Delta T\delta A\,l \quad (1)$$

wherein:

Q=the maximum energy absorption capacity, v=the volume of the shunt, $\Delta T=T_{melting}-T_{ambient}$, $T_{melting}$=the melting point temperature for the shunt material $T_{ambient}$=the ambient temperature $C_p$=the specific heat capacity of the shunt material, δ=the density of the shunt material, A=the cross sectional area of the shunt, and l=the length of the shunt material.

* * * * *